US012060218B2

(12) United States Patent
Besso et al.

(10) Patent No.: US 12,060,218 B2
(45) Date of Patent: Aug. 13, 2024

(54) CONTAINER WITH EXPANDABLE SPACER FOR USED AND UNUSED CONSUMER GOODS

(71) Applicant: PHILIP MORRIS PRODUCTS S.A., Neuchâtel (CH)

(72) Inventors: Clement Besso, Neuchâtel (CH); Digvijay Singh, Pully (CH); Julie Polier, Neuchâtel (CH)

(73) Assignee: Philip Morris Products S.A., Neuchâtel (CH)

( * ) Notice: Subject to any disclaimer, the term of this patent is extended or adjusted under 35 U.S.C. 154(b) by 10 days.

(21) Appl. No.: 17/920,917

(22) PCT Filed: Apr. 16, 2021

(86) PCT No.: PCT/IB2021/053159

§ 371 (c)(1),
(2) Date: Oct. 24, 2022

(87) PCT Pub. No.: WO2021/214611

PCT Pub. Date: Oct. 28, 2021

(65) Prior Publication Data

US 2023/0312225 A1 Oct. 5, 2023

(30) Foreign Application Priority Data

Apr. 24, 2020 (EP) ..... 20171336

(51) Int. Cl.
*B65D 85/10* (2006.01)
*B65D 5/66* (2006.01)

(52) U.S. Cl.
CPC ..... *B65D 85/1081* (2013.01); *B65D 5/6691* (2013.01); *B65D 85/1045* (2013.01); *B65D 2209/00* (2013.01)

(58) Field of Classification Search
CPC ..... B65D 5/66; B65D 5/6691; B65D 85/10; B65D 85/1045; B65D 85/1081; B65D 2209/00

(Continued)

(56) References Cited

U.S. PATENT DOCUMENTS 2,079,815 A * 5/1937 Ringler ..... B65D 5/5475 206/256
2019/0002187 A1 1/2019 Kahawaiolaa et al.

FOREIGN PATENT DOCUMENTS

DE 29918461 U1 3/2000
GB 2535444 A 8/2016

OTHER PUBLICATIONS

International Search Report and Written Opinion for PCT/IB2021/053159 issued by the European Patent Office, Jul. 15, 2021; 10 pgs.

(Continued)

*Primary Examiner* — Bryon P Gehman
(74) *Attorney, Agent, or Firm* — Mueting Raasch Group

(57) ABSTRACT

The container may comprise a box, a lid, at least a first bundle and a second bundle of consumer goods, and an expandable spacer. The expandable spacer comprises at least one spacer weakening line. The at least one spacer weakening line is provided on the spacer bottom wall. The expandable spacer has an initial size that is defined by an initial distance between the first side wall and the second side wall of the expandable spacer for containing a predetermined number of consumer goods. The spacer weakening line is configured to break when more than the predetermined number of consumer goods are inserted between the expandable spacer walls so that the first and the second side walls of the expandable spacer are spaced further apart. Methods of using disclosed containers are also disclosed.

20 Claims, 3 Drawing Sheets

(58) Field of Classification Search
USPC ..... 206/256
See application file for complete search history.

(56) References Cited

OTHER PUBLICATIONS

European Search Report for EP 20171336.9, issued by the European Patent Office, Aug. 10, 2020; 5 pgs.

* cited by examiner

CONTAINER WITH EXPANDABLE SPACER FOR USED AND UNUSED CONSUMER GOODS

This application is the § 371 U.S. National Stage of International Application No. PCT/IB2021/053159, filed 16 Apr. 2021, which claims the benefit of European Application No. 20171336.9, filed 24 Apr. 2020, the disclosures of which are incorporated herein by reference.

The present disclosure relates to containers that may hold both used and unused consumer goods, in particular rod-shaped consumer goods.

Disposal of used consumables is a known issue in the tobacco industry and contributes to littering problems all over the world. After consuming an aerosol-generating article, such as a cigarette, it may be difficult for a user to find a convenient location to dispose of the used article. For example, the user may not be located near to an ashtray or a suitable disposal bin. Therefore, in some circumstances, the user may find it difficult to appropriately dispose of the used article. This problem may be exacerbated when the aerosol-generating article is heated during use without combustion. For example, a number of aerosol-generating systems are known in which an aerosol-generating article, which may be cigarette-like in size and shape, are electrically heated rather than combusted. In such systems, the article may be approximately the same size both before and after use. Therefore, disposal of such articles may be more difficult for a user when compared to a conventional cigarette of which substantially only the filter typically remains after use.

Therefore, it would be desirable to provide a convenient manner for a user to manage the disposal of used aerosol-generating articles.

According to aspects of the present invention, there is provided a container for consumer goods, in particular rod-shaped consumer goods. The container may comprise a box, a lid, at least a first bundle and a second bundle of consumer goods, and an expandable spacer. The box is for housing the consumer goods and comprises a box front wall, a box back wall, a box bottom wall, and two opposite box side walls. The top face of the box is at least partially open to provide an access opening for accessing the consumer goods. The lid is pivotably connected to the box back wall along a hinge line. The lid is movable along the hinge line between a closed position in which the lid covers the access opening and an open position in which the access opening is exposed. The expandable spacer comprises a first side wall, an opposing second side wall, a bottom wall positioned between the first side wall and the second side wall, and at least one spacer weakening line provided on the spacer bottom wall. The expandable spacer has an initial size that is defined by an initial distance between the first side wall and the second side wall of the expandable spacer for containing a predetermined number of consumer goods. The expandable spacer is positioned within the box between the first and second bundles of consumer goods. The first side wall of the expandable spacer may be adjacent the first bundle of consumer goods and the second side wall of the expandable spacer may be adjacent the second bundle of consumer goods. The spacer weakening line is configured to break when more than the predetermined number of consumer goods are inserted between the expandable spacer walls so that the first and the second side walls of the expandable spacer are spaced further apart.

Aspects of the invention may also include methods of using a container of consumer goods. The method comprises obtaining a container of consumer goods. The container may comprise a box, a lid, at least a first bundle and a second bundle of consumer goods, and an expandable spacer. The box is for housing the consumer goods and comprises a box front wall, a box back wall, a box bottom wall, and two opposite box side walls. The top face of the box is at least partially open to provide an access opening for accessing the consumer goods. The lid is pivotably connected to the box back wall along a hinge line. The lid is movable along the hinge line between a closed position in which the lid covers the access opening and an open position in which the access opening is exposed. The expandable spacer comprises a first side wall, an opposing second side wall, a bottom wall positioned between the first side wall and the second side wall, and at least one spacer weakening line provided on the bottom wall. The expandable spacer has an initial size that is defined by an initial distance between the first side wall and the second side wall of the expandable spacer for containing a predetermined number of consumer goods. The expandable spacer is positioned within the box between the first and second bundles of consumer goods. The first side wall of the expandable spacer may be adjacent the first bundle of consumer goods and the second side wall of the expandable spacer may be adjacent the second bundle of consumer goods. Upon insertion of more than the predetermined number of consumer goods into the expandable spacer, the spacer weakening line is configured to break so that the first and the second side walls of the expandable spacer are spaced further apart. A next step in a method described herein may include removing a first portion of the inner liner that covers the first bundle of consumer goods by breaking the first inner liner weakening line and at least a portion of the second inner liner weakening line. A next step may include removing a first consumer good from the first bundle of consumer goods. The consumer goods may be used before the first consumer good is placed into the expandable spacer.

Containers and methods configured in the manner described above may provide containers and methods of using containers that afford a consumer an easy solution to containing used consumer goods, in particular all of the consumer goods provided in the container, until the container and entire contents thereof may be disposed of properly and responsibly. Even more advantageously, the container is not substantially larger than existing containers. Additionally, containers described herein may be easy to use and may contain both used and unused consumer goods and keep the used and unused consumer goods separately from each other. Containers described herein make it easy for the first used consumer goods to be inserted into the container without catching the inner liner. In some particularly disclosed containers, the expandable spacer may include odour absorbents which may advantageously reduce the odour or taste transmission of the used consumer goods on the unused consumer goods.

The box comprises a box front wall, a box back wall, a box bottom wall and two opposite box side walls, wherein a top face of the box is at least partially open to provide an access opening for accessing consumer goods contained therein. The front wall of the box may include a notch. The notch may alert the consumer that the container has the feature of containing the used goods. The notch may provide an alternative way for the consumer to place the used goods into the expandable spacer instead of having to be vertically inserted into the top opening of the container. The notch may have a length along the top periphery of the box that is the same as the initial distance between the first and second side walls of the expandable spacer.

The lid comprises a lid top wall, a lid back wall, a lid front wall and two opposite lid side walls. The lid is pivotably connected to the box back wall along a hinge or hinge line. The lid is movable along the hinge between a closed position, in which the lid covers the access opening of the box, and an open position, in which the access opening of the box is exposed. The lid side wall, the lid front wall, and the lid back wall may be respectively aligned on the same plane with the box side wall, the box side wall, and the box back wall when the lid is in the closed position.

The container comprising the box and the lid, may be formed from any suitable materials including, but not limited to, cardboard, plastic, metal, or combinations thereof. The cardboard may have a weight of between about 100 grams per square meter and about 350 grams per square meter. Preferably, the box and the lid are formed from a single laminar blank.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof. Where the container includes one or more rounded edges, preferably the blanks forming the container (box and lid) include three, four, five, six, or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and about 4 mm.

The container is sized to contain at least two bundles of consumer goods—a first bundle of consumer goods and a second bundle of consumer goods. The first bundle of consumer goods is positioned adjacent the first wall of the box and the second bundle of consumer goods is positioned adjacent the second wall of the box. Preferably, the consumer goods are elongated consumer articles, such as rod-shaped consumer goods. The rod-shaped consumer goods may be described by the diameter thereof. Containers according to the invention find particular application as containers for aerosol generating articles or components of aerosol generating articles. Prior to the first opening thereof, the filled container may be wrapped in an outer wrapper.

The number of consumer goods in each bundle contained in the containers according to the invention may vary. In some particular embodiments, the bundles of consumer goods may include a single row of consumer goods and in some embodiments, the bundles may include more than one row of consumer goods. In some particular embodiments, each bundle of consumer goods may include two rows of at least 5 consumer goods or at least two rows of 10 consumer goods.

Containers described herein may also include an inner liner. The inner liner functions to wrap the at least first and second bundles of consumer goods. The inner liner may also function to wrap the expandable spacer. The inner liner includes a first inner liner weakening line that is generally vertical from the bottom of the box to the top of the box. In particular, the first inner liner weakening line may preferably be positioned along or between either the first or the second side wall of the expandable spacer when the inner liner and the expandable spacer are positioned in the box. The inner liner also includes a second inner liner weakening line that may extend parallel to a plane from one side wall of the box to the other side wall of the box. In particular, the second inner liner weakening line may preferably be positioned near to or preferably adjacent to the box bottom wall when the inner liner is positioned inside the box and wrapping the first and second bundles of consumer goods. In some embodiments, the second inner liner weakening line may traverse from one side wall of the box to the second side wall of the box. The first inner liner weakening line and at least a portion of the second inner liner weakening line may be broken upon removing a portion of the inner liner that covers the first bundle of consumer goods or the second bundle of consumer goods. In particular, a first portion of the inner liner covering the first bundle of consumer goods may be removed by breaking the first inner liner weakening line and at least a portion of the second inner liner weakening line.

The inner liner may be formed from any suitable materials, including but not limited to, paper, polymeric materials, metal foils, other materials, or combinations thereof.

Containers described herein also include an expandable spacer. The expandable spacer includes a first side wall, an opposing second side wall and a bottom wall. The bottom wall of the expandable spacer includes a first edge adjacent the first side wall and an opposing second edge adjacent the second side wall. The bottom wall is positioned between the first side wall and the second side wall. The expandable spacer may also include side flaps. Each of the first side wall and second side wall may each have two side flaps. The side flaps may be formed by crease lines on the perimeters of the first side wall and second side walls respectively. The side flaps may function to provide the expandable spacer with additional structural integrity both before and after the spacer weakening line is broken. The side flaps may also function to more easily allow the two side walls to slide within the box once the spacer weakening line has been broken.

The expandable spacer is adapted so that the distance between the side walls of the spacer may be expanded. This is made possible by breaking the bottom wall from at least one of the side walls. The expandable spacer may be described as having an initial size that may be defined in part by an initial distance between the first and second side walls. The initial distance between the two side walls may be at least as large as a width of a consumer good that is to be contained in the container. The initial size of the expandable spacer may contain a predetermined number of consumer goods. Preferably, the initial distance between the two side walls may be at least as large as the diameter of a rod-shaped good that is to be contained in the container. Preferably, the initial size of the expandable spacer may contain at least two consumer goods, or the predetermined number of consumer goods is two.

The expandable spacer is positioned within the box between the first and second bundles of consumer goods. The first side wall of the expandable spacer may be adjacent the first bundle of consumer goods. The second side wall of the expandable spacer may be adjacent the second bundle of consumer goods. The expandable spacer is not bound to any portion of the box and is merely at least partially contained by the box. The expandable spacer is also initially contained within the inner liner.

The expandable spacer includes at least one spacer weakening line. The at least one spacer weakening line may be positioned on the spacer bottom wall. In some preferred embodiments, the at least one spacer weakening line may n be positioned along the first edge of the bottom wall or along the second edge of the bottom wall. The at least one spacer weakening line is configured to break when more than the predetermined number of consumer goods are inserted into the expandable spacer so that the first and second side walls of the expandable spacer are forced further apart. The expandable spacer expands towards whichever bundle the consumer good was removed from to account for the additional number of inserted goods. For example, if the predetermined amount is two, when inserting the third consumer good into the expandable spacer, the expandable spacer will expand towards whichever bundle the third consumer good was removed from. In particular, if the third consumer good was removed from the first bundle, used and placed into the expandable spacer, the expandable spacer will expand towards the first bundle. If the consumer goods were removed from both bundles, the expandable spacer may expand towards either of the bundles.

Once the entirety of the first bundle of consumer goods is used and placed into the expandable spacer, the first wall of the expandable spacer may have been nearer to the first side wall of the box (assuming all of the consumer goods were removed from the first bundle) by the placement of the consumer goods into the expandable spacer. Removal of the portion of the inner liner that covers the first bundle of consumer goods exposes the first bundle of consumer goods to the user for use and allows the first side wall of the expandable spacer to more easily move towards the first side wall of the box as the additional consumer goods in the first bundle are placed in the space between the first side wall of the expandable spacer and the first side wall of the box. Upon opening the second bundle of consumer goods, a second portion of the inner liner may be removed by breaking a second portion of the second inner liner weakening line. Removal of the portion of the inner liner that covers the second bundle of consumer goods exposes the second bundle of consumer goods to the user for use and allows the second side wall of the expandable spacer to more easily move towards the second side wall of the box as the additional consumer goods in the second bundle are placed in the space between the second side wall of the expandable spacer and the second side wall of the box.

The expandable spacer may be formed from any suitable materials including, but not limited to, cardboard, plastic, metal, or combinations thereof. The cardboard may have a weight of between about 100 grams per square meter and about 350 grams per square meter. Preferably, the expandable spacer is formed from a single laminar blank.

The expandable spacer may be made of a material that is odour absorbing. For example, the expandable spacer may comprise activated carbon or may be made of activated carbon containing paper. In particular, the expandable spacer may be made of a material that includes at least 40% by weight of activated carbon. Such activated carbon containing paper may have a weight of about 190 $g/m^2$ and a thickness of about 500 micrometers (μm).

The container may also comprise an optional inner frame disposed within the box. Advantageously, the inner frame with a front wall provided adjacent the front wall of the box increases the structural strength of the container. The inner frame may also be wrapped inside the inner liner. Alternatively, the inner frame may be disposed outside the inner liner. The front wall of the inner frame may also include a notch, whose size and position correspond to the notch provided on the front wall of the box. Such notches on the inner frame and the box may provide the consumer an alternative way of placing the used goods into the expandable spacer instead of having to be vertically inserted into the top opening of the container.

The exterior surfaces of containers according to the invention may be printed, embossed, debossed or otherwise embellished with manufacturer or brand logos, trademarks, slogans and other consumer information and indicia.

A carton may contain multiple containers as described herein. As well as housing aerosol-generating articles, such as, alkaloid-containing consumer articles, the container may further include other consumer goods, for example, matches, lighters, extinguishing means, breath-fresheners, or electronics. The other consumer goods may be attached to the outside of the container, contained within the container along with the aerosol-generating articles, in a separate compartment of the container, or combinations thereof.

Also disclosed herein are particular methods of using containers of consumer goods. Such methods include obtaining a container of consumer goods as described herein. A first step in methods includes removing at least a portion of the inner liner to reveal the consumer goods in a first bundle. This step includes breaking at least a first inner liner weakening line and at least a portion of the second inner liner weakening line. This portion of the inner liner may then be entirely removed from the box. Removing this portion of the inner liner exposes the consumer goods in the first bundle.

Once the first bundle of consumer goods is exposed, the user may then remove at least one consumer good from the first bundle. The at least one consumer good may then be used. It is noted that the particular consumer goods referred to herein may not entirely be consumed by being used.

The used consumer good is then placed into the expandable spacer. Placement of the first consumer good does not break the weakening line of the expandable spacer and therefore does not change the expandable spacer from its initial size that is designed to hold a predetermined number of consumer goods.

Further optional steps in disclosed methods may include removing additional consumer goods from the first bundle of consumer goods. The additional consumer goods may be used. Upon placing a cumulative number of consumer goods into the expandable spacer, which is more than the predetermined number of consumer goods, the weakening line of the expandable spacer may be broken, allowing the expandable spacer to expand by spacing the first and second side walls of the expandable spacer further apart. In some preferred embodiments, the predetermined number of consumer goods is two and placement of the third consumer goods into the expandable spacer will break the weakening line of the expandable spacer and force a first side wall of the expandable spacer towards the first bundle of consumer goods to make room for the third consumer good therein. Removal of additional consumer goods from the first bundle of consumer goods and placement thereof into the expandable spacer will force the first side wall of the expandable spacer further towards a first side wall of the box to make room for the additional consumer goods in the expandable spacer. These steps may optionally continue until all of the consumer goods in the first bundle are removed from the first bundle. As the entirety of the consumer goods from the first bundle are placed into the expandable spacer, the first side wall of the expandable spacer will eventually be forced near to the first side wall of the box to make room for all of the consumer goods of the first bundle in the expandable spacer.

Further optional steps in disclosed methods may include removing a portion of the inner liner that covers the second bundle of consumer goods by breaking a second portion of the second weakening line of the inner liner. This step may function to expose the consumer goods of the second bundle.

Removal of consumer goods from the second bundle of consumer goods and placement thereof into the expandable spacer will force the second side wall of the expandable spacer towards a second side wall of the box to make room for the additional consumer goods in the expandable spacer. Removal of additional consumer goods from the second bundle of consumer goods and placement thereof into the expandable spacer will force the second side wall of the expandable spacer towards a second side wall of the box to make room for the additional consumer goods in the expandable spacer. These steps may optionally continue until all of the consumer goods in the second bundle are removed from the second bundle. As the entirety of the consumer goods from the second bundle are placed into the expandable spacer, the second side wall of the expandable spacer will eventually be forced nearer to the second side wall of the box to make room for all of the consumer goods of the second bundle in the expandable spacer.

Optional methods may include placing all consumer goods from the first bundle and the second bundle into the expandable spacer.

According to various aspects of the present invention, a method for sustainably and responsibly disposing of used consumer goods is provided. Preferably, a method for sustainably and responsibly disposing of used consumer goods that does not necessarily require a second container or even a substantially larger container for containment of the used consumer goods is provided. The containers and methods furthermore do not require the consumer to utilize any structure external to the box itself. The expandable spacer may even be made to minimize or prevent any perceived negative impact, for example odour or taste transmission, of the used consumer goods on the unused consumer goods.

As used herein, the singular forms "a," "an," and "the" also encompass embodiments having plural referents, unless the content clearly dictates otherwise.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

As used herein, "providing," in the context of providing an apparatus or system, means manufacturing the apparatus or system, purchasing the apparatus or system, or otherwise obtaining the apparatus or system.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations. References to first and second (and so on) are meant only for clarifying purposes and do not imply and additional meaning.

The term "adjacent" refers to a location relative to another object. The term "near" or the phrase "near to" is used to describe a location relative to another object that is further away than "adjacent" is.

The term "hinge line" or "hinge" refers to a line about which two elements may be pivoted relative to each other. A hinge line may be, for example, a fold line, a perforation line or score line in a wall or panel of the container, or between two walls of the container.

The term "wall" refers to a facet of the container, and a wall may be formed from a single panel or flap, or a wall may be formed from two or more abutting or overlapping panels or flaps.

The term "weakening line" is used to describe a line formed by partially cutting into the material of the blank. A weakening line may be formed by removing material from the blank (in which case the weakening line forms a groove or trough in the blank). As an alternative, a weakening line may be formed without removing any material from the blank, typically involving a partial sideways displacement and compression of material, caused by a knife with a non-zero thickness penetrating the material. The depth of the weakening line will be less than the thickness of the blank.

The term "creasing line" is used to describe a line formed by displacing a portion of the material vertical to the plane of the blank, forming a groove or trough in the blank. The displacement may involve compression and typically involves the use of a compression tool, such as a roller. Alternatively, or in addition, the material in the creasing line may be displaced so as to at least partially protrude from the opposite side of the blank. Generally, no material is removed when a creasing line is formed.

The invention is defined in the claims. However, below there is provided a non-exhaustive list of non-limiting examples. Any one or more of the features of these examples may be combined with any one or more features of another example, embodiment, or aspect described herein. The invention will now be further described, by way of example of only, with reference to the figures in which:

Figure 1:
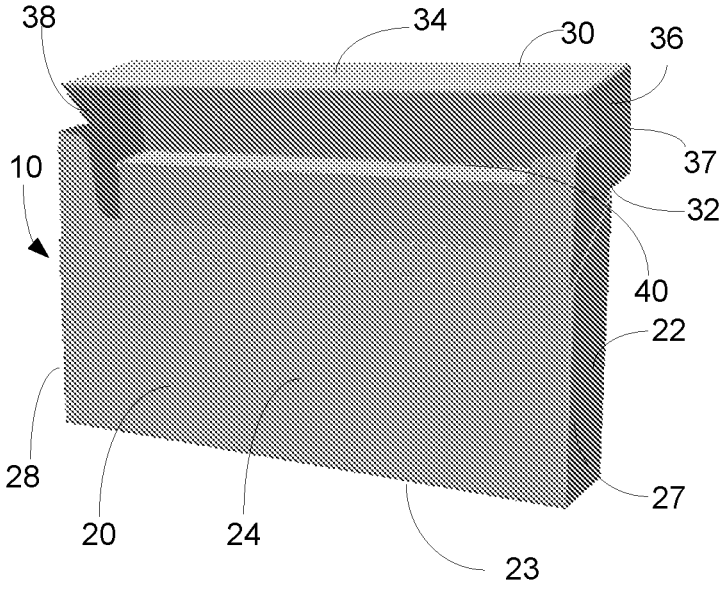
FIG. 1 is a schematic perspective view of a container.

FIG. 1 shows a container 10 in a partially opened position. The container 10 comprises a box 20 and a lid 30.

The box 20 comprises a box back wall 22 extending between a box first side wall 27 and a box second side wall 28. The box bottom wall 23 is orthogonal to the box first side wall 27 and the box second side wall 28 and extends between the box first side wall 27 and box second side wall 28. The box first side wall 27 and the box second side wall 28 are orthogonal to a box front wall 24 disposed opposite the box back wall 22.

The lid 30 comprises a lid top wall 36 extending between a lid front wall 34 and lid back wall 32 and between a lid first side wall 37 and lid second side wall 38. The lid first side wall 37 and the lid second side wall 38 are orthogonal to the lid top wall 36 and extend between the lid front wall 34 and the lid back wall 32.

The lid back wall 32 extends from a hinge line 40 along a top edge of the box back wall 22. The lid 30 is movable about the hinge line 40 between the closed position and an open position. The hinge line 40 extends between the box first side wall 27 and the box second side wall 28.

The box 20 is arranged and configured to receive consumer goods. The consumer goods may have a longitudinal length that is generally orthogonal with the hinge line 40. Preferably, the consumer goods are elongated articles such as aerosol generating articles, where the longitudinal length or axis is generally orthogonal with the hinge line 40. The consumer goods may be extracted from an access opening defined at a top side of the box 20.

Figure 2:
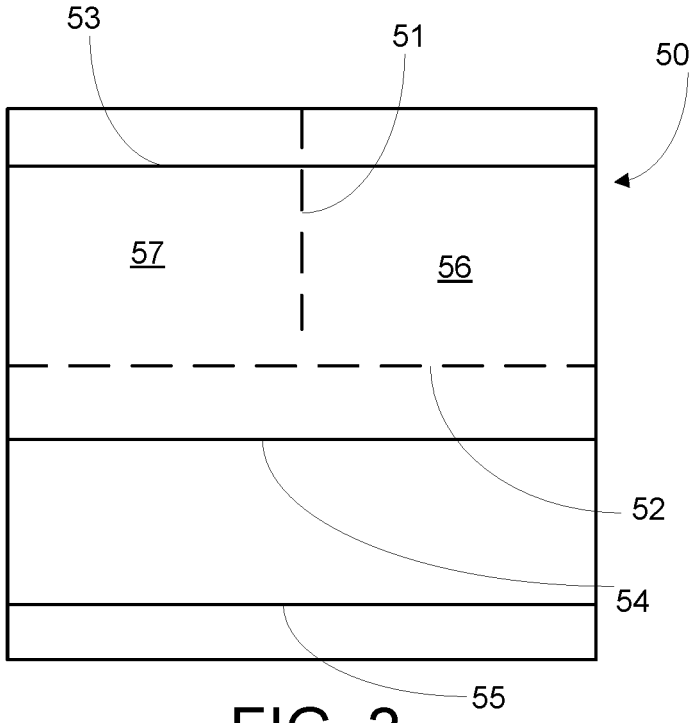
FIG. 2 is a schematic perspective view of an inner liner.

FIG. 2 shows an inner liner 50 before being placed in a container. This particular inner liner 50 is made from a single piece of material. The inner liner 50 includes a first inner liner weakening line 51 and a second inner liner weakening ling 52. The first inner liner weakening line 51 and the second inner liner weakening line 52 define a first portion 56 and a second portion 57 of the inner liner. The inner liner 50 may also optionally include a first crease line 53, a second crease line 54, and a third crease line 55. The first crease line 53, the second crease line 54, and the third crease line 55 may be used to facilitate folding the inner liner for better covering a first and second bundle of consumer goods when the inner liner 50 is wrapping the first and second bundle of consumer goods within the container.

Figure 3:
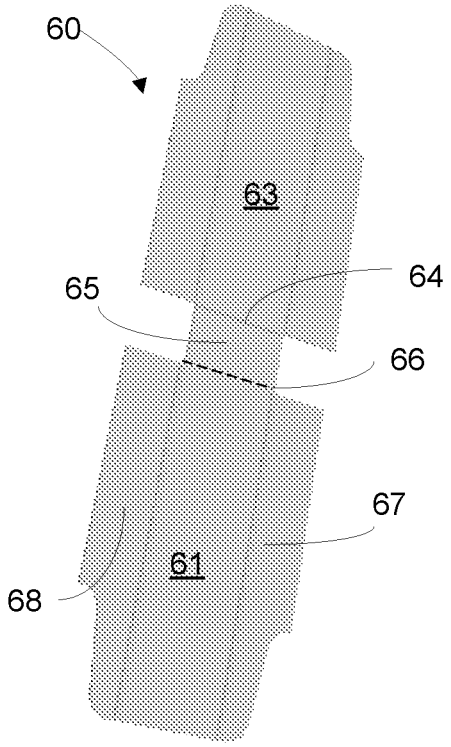
FIG. 3 is a schematic perspective view of a blank of an expandable spacer.
Figure 4:
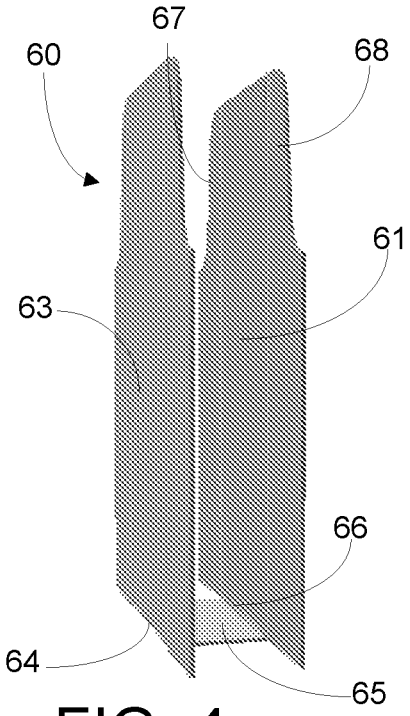
FIG. 4 is a schematic perspective view of an expandable spacer.

FIG. 3 shows a blank of an expandable spacer 60. The expandable spacer 60 includes a first side wall 61 and a second side wall 63 that are spanned by a bottom portion 65. Adjacent a bottom edge of the first side wall 61 and the second side wall 63 are a first weakening line 66 and a bottom crease line 64 respectively. Each of the first side wall 61 and the second side wall 63 may also optionally include a first side flap 67 and a second side flap 68 that are formed by folding along first and second crease lines on the first side wall 61 and the second side wall 63 respectively. FIG. 4 shows the expandable spacer 60 once it is at least partially formed by folding the first side wall 61 and the second side wall 63 towards each other along the first weakening line 66 and the bottom crease line 64. In this view, the first side flap 67 and the second side flap 68 of the first side wall 61 and the second side wall 63 are not yet folded towards the bottom portion 65 of the expandable spacer 60.

Figure 5:
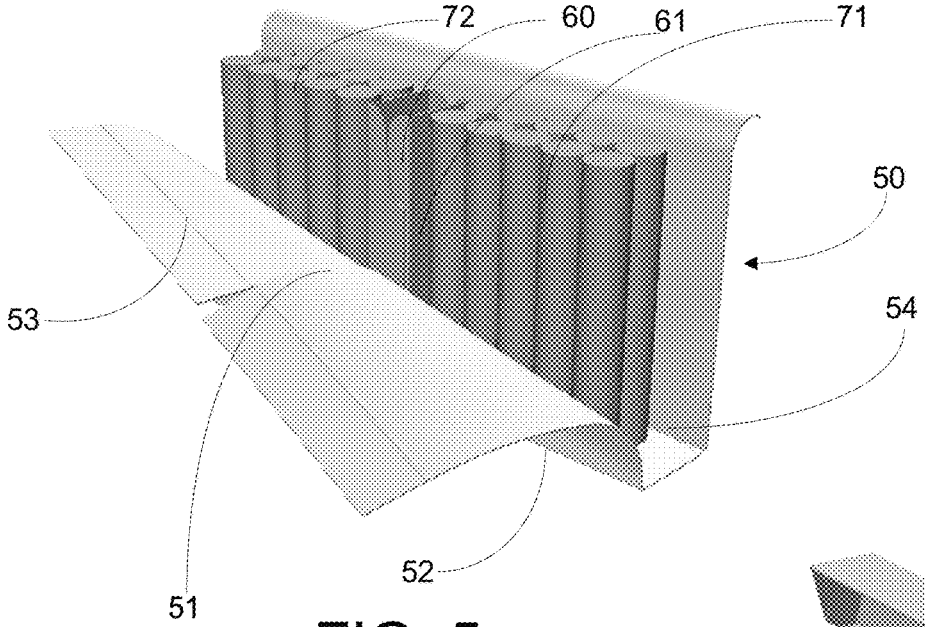
FIG. 5 is a schematic perspective view of an inner liner that is containing an expandable spacer and two bundles of consumer goods.

FIG. 5 shows a first bundle of consumer goods 71, a second bundle of consumer goods 72, and an expandable spacer 60 that are within an inner liner 50. The first weakening line 51 of the inner liner 50 may be seen as positioned along the first side wall 61 of the expandable spacer 60.

The second weakening line 52 of the inner liner 50 may be seen as positioned along the bottom of the first 71 and second bundles of consumer goods 72 which may be adjacent the perimeter of the front wall 24 and the bottom wall 23 of the box 20 when inserted into the container 10. This view of the inner liner shows the optional first crease line 53, which allows a portion of the inner liner 50 to be folded over the first 71 and second 72 bundles of consumer goods. The second crease line 54 is adjacent the bottom back of the first and second bundles of consumer goods.

Figure 6:
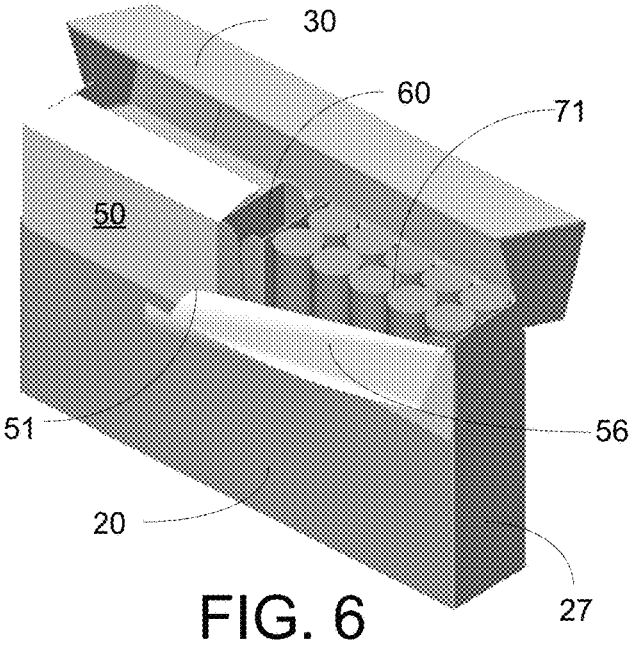
FIG. 6 is a schematic perspective view of a container with a portion of an inner liner in the process of being removed.

FIG. 6 shows the first portion 56 of the inner liner 50 within the container after a portion of the first portion 56 of the inner liner 50 has been peeled back in order to be removed. As seen in this figure, a portion of the first weakening line 51 has already been broken.

Figure 7:
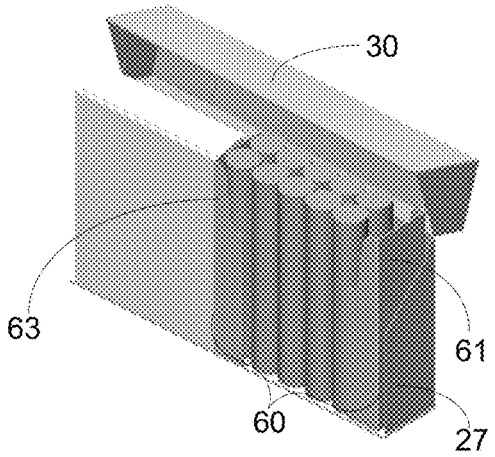
FIG. 7 is a schematic perspective partial cut-out view of a container showing a first side wall of an expandable spacer nearer to the first side wall of the box.

FIG. 7 shows a partial cut-out view of the container after a certain number, in this case, 10 consumer goods have been placed into the expandable spacer 60 and the first wall 61 of the expandable spacer 60 has been forced over to the first side wall 27 of the box 20. As seen in this figure, the second side wall 63 of the expandable spacer 60 has yet to be moved. As also noted in this figure, the expandable spacer has an expanded size that holds 10 consumer goods, the entire amount that were included in the first bundle of consumer goods 71.

Figure 8:
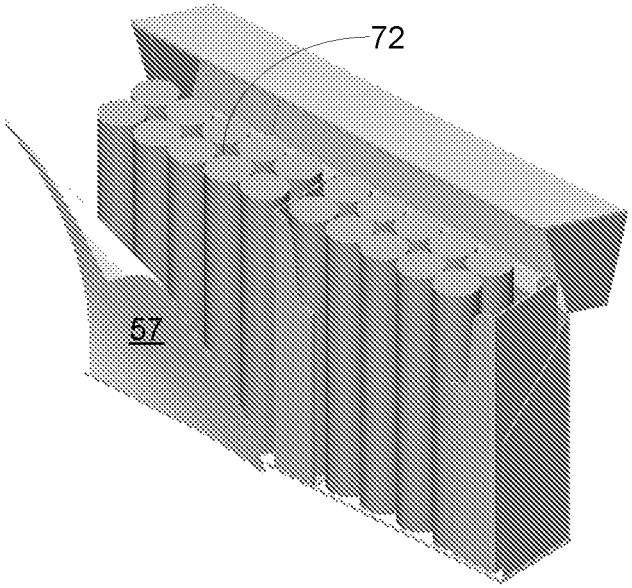
FIG. 8 is a schematic perspective partial cut-out view of a container showing a second portion of an inner liner in the process of being removed.

FIG. 8 shows the second portion 57 of the inner liner within the container after a portion of the second portion 57 of the inner liner has been peeled back in order ultimately to be removed from the second bundle of consumer goods 72.

Figure 9:
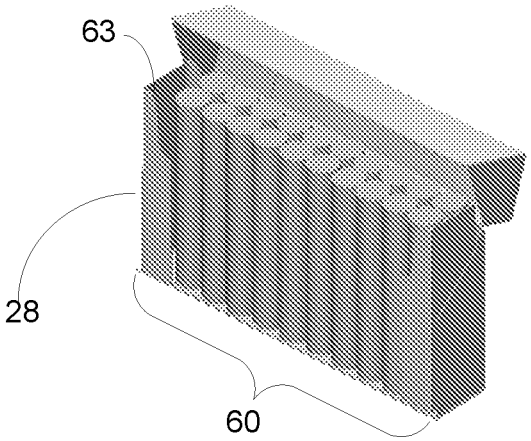
FIG. 9 is a schematic perspective partial cut-out view of a container showing a second side wall of an expandable spacer nearer to the second side wall of the box.

FIG. 9 shows a partial cut-out view of the container after a certain additional number, in this case, 10 consumer goods from the second bundle of consumer goods have been placed into the expandable spacer 60 and the second wall 63 of the expandable spacer 60 has been forced over to the second side wall 28 of the box 20.

Figure 10:
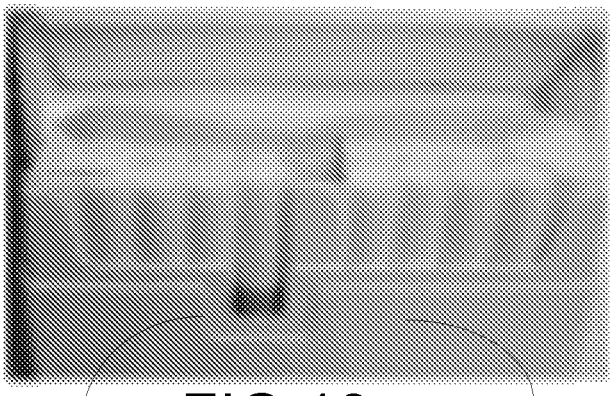
FIG. 10 is a schematic perspective view of a container that includes an optional notch in the box.

FIG. 10 shows a perspective view of a container that includes a front wall 24 of a box that includes an optional notch 29 that is cut out of the front wall 24 to aide in placing the consumer goods into the expandable spacer.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±2% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A container for consumer goods, the container comprising:

a box for housing consumer goods, the box comprising a box front wall, a box back wall, a box bottom wall and two opposite box side walls, wherein a top face of the box is at least partially open to provide an access opening for accessing the consumer goods, a lid pivotably connected to the box back wall along a hinge and the lid is movable along the hinge between a closed position, in which the lid covers the access opening, and an open position, in which the access opening is exposed, at least a first bundle and a second bundle of consumer goods, and an expandable spacer comprising a first side wall, an opposing second side wall, a bottom wall positioned between the first side wall and the second side wall, and at least one spacer weakening line provided on the spacer bottom wall, the expandable spacer having an initial size defined by an initial distance between the first side wall and the second side wall of the expandable spacer for containing a predetermined number of consumer goods, wherein the expandable spacer is positioned within the box between the first and second bundles of consumer goods, the first side wall of the expandable spacer being adjacent the first bundle of consumer goods and the second side wall of the expandable spacer being adjacent the second bundle of consumer goods and wherein the at least one spacer weakening line is configured to break when more than the predetermined number of consumer goods are inserted between the expandable spacer walls so that the first and second side walls of the expandable spacer are spaced further apart.

2. The container of claim 1, wherein the at least one spacer weakening line is positioned along a first edge of the bottom wall adjacent either the first side wall or the second side wall of the expandable spacer.

3. The container of claim 1, wherein the box front wall comprises a notch that aligns with an initial position of the expandable spacer in the box.

4. The container of claim 3, wherein the size of the notch is configured so that at least one consumer good is able to pass through the notch into the expandable spacer.

5. The container of claim 1, further comprising an inner liner, wherein the expandable spacer and the first bundle and second bundle of consumer goods are wrapped inside the inner liner.

6. The container of claim 5, further comprising an inner frame disposed within the box and outside the inner liner.

7. The container of claim 5, wherein the inner liner comprises a first inner liner weakening line positioned along either of the first side wall or the second side wall of the expandable spacer and a second inner liner weakening line positioned adjacent the box bottom wall.

8. The container of claim 7, wherein both the first inner liner weakening line and at least a portion of the second inner liner weakening line are configured to break upon removing a first portion of the inner liner that covers the first bundle of consumer goods.

9. The container of claim 1, wherein the expandable spacer comprises a material that is odour absorbing.

10. The container of claim 1, wherein the expandable spacer comprises activated carbon.

11. The container of claim 10, wherein the first side of the expandable spacer is configured to move towards the first bundle of consumer goods when the consumer goods in the first bundle are inserted into the expandable spacer.

12. The container of claim 1, wherein the expandable spacer is configured for containing used consumer goods.

13. The container of claim 1, wherein the expandable spacer further comprises two opposing side flaps on each of the first and second side walls.

14. The container of claim 1, further comprising an inner frame disposed within the box, the inner frame having a front wall provided adjacent to the front wall of the box.

15. The container of claim 1, wherein the expandable spacer comprises one of cardboard, plastic, and metal.

16. The container of claim 1, wherein the expandable spacer is formed from a single laminar blank.

17. A method of using a container of consumer goods, the method comprising:

obtaining a container of consumer goods, the container comprising:

a box for housing consumer goods, the box comprising a box front wall, a box back wall, a box bottom wall and two opposite box side walls, wherein a top face of the box is at least partially open to provide an access opening for accessing consumer goods, a lid pivotably connected to the box back wall along a hinge and the lid is movable along the hinge between a closed position, in which the lid covers the access opening, and an open position, in which the access opening is exposed, at least a first and second bundle of consumer goods, an expandable spacer comprising a first side wall, an opposing second side wall, a bottom wall positioned between the first side wall and the second side wall, and at least one spacer weakening line positioned on the spacer bottom wall, the expandable spacer having an initial size defined by an initial distance between the first side wall and the second side wall of the expandable spacer for containing a predetermined number of consumer goods, and an inner liner that wraps the first and second bundles of consumer goods wherein the inner liner comprises a first inner liner weakening line positioned along either the first or the second side wall of the expandable spacer and a second inner liner weakening line positioned adjacent the box bottom wall, wherein the expandable spacer is positioned within the box between the first and second bundles of consumer goods, the first side wall of the expandable spacer being adjacent the first bundle of consumer goods and the second side wall of the expandable spacer being adjacent the second bundle of consumer goods and wherein upon insertion of more than the predetermined number of consumer goods, the at least one spacer weakening line is configured to break so that the first and second side walls of the expandable spacer are spaced further apart;

removing a first portion of the inner liner that covers the first bundle of consumer goods by breaking the first inner liner weakening line and at least a portion of the second inner liner weakening line, removing a first consumer good from the first bundle of consumer goods, using the first consumer good, and placing the used first consumer good into the expandable spacer.

18. The method of claim 17, further comprising removing all of the consumer goods from the first bundle of consumer goods, using all of the consumer goods from the first bundle of consumer goods and placing all of the used consumer goods from the first bundle of consumer goods into the expandable spacer, wherein upon placing all of the used consumer goods from the first bundle of consumer goods into the expandable spacer, the first wall of the expandable spacer is positioned near the first box side wall.

19. The method of claim 18, further comprising removing a second portion of the inner liner that covers the second bundle of consumer goods by breaking a remaining portion of the second inner liner weakening line.

20. The method of claim 19, further comprising removing a first consumer good from the second bundle of consumer goods, using the first consumer good from the second bundle of consumer goods, and placing the used first consumer good into the expandable spacer, thereby moving the second wall of the expandable spacer towards the second side wall of the box.

* * * * *